US008474296B2

(12) United States Patent
Schneider

(10) Patent No.: US 8,474,296 B2
(45) Date of Patent: Jul. 2, 2013

(54) FORMATION TOOL FOR A PUNCHING MACHINE

(75) Inventor: Albrecht Schneider, Oberursel (DE)

(73) Assignee: Mate Precision Tooling Inc., Anoka, MN (US)

( * ) Notice: Subject to any disclaimer, the term of this patent is extended or adjusted under 35 U.S.C. 154(b) by 0 days.

(21) Appl. No.: 13/480,037

(22) Filed: May 24, 2012

(65) Prior Publication Data

US 2012/0227458 A1 Sep. 13, 2012

Related U.S. Application Data

(62) Division of application No. 12/160,514, filed as application No. PCT/US2007/000657 on Jan. 11, 2007, now abandoned.

(30) Foreign Application Priority Data

Jan. 11, 2006 (DE) ..... 10 2006 001 389

(51) Int. Cl.
*B21D 22/00* (2006.01)

(52) U.S. Cl.
USPC ..... 72/351; 72/465.1

(58) Field of Classification Search
USPC ..... 72/344–346, 427, 351, 465.1, 466.9, 72/482.91, 404–405.01; 83/164
See application file for complete search history.

(56) References Cited

U.S. PATENT DOCUMENTS

| | | | | |
|---|---|---|---|---|
| 4,193,285 | A | 3/1980 | Zumsteg | |
| 4,434,639 | A * | 3/1984 | Bredow | 72/344 |
| 5,507,167 | A * | 4/1996 | Statezni et al. | 72/355.6 |

FOREIGN PATENT DOCUMENTS

| | | |
|---|---|---|
| DE | 908 122 | 4/1954 |
| FR | 2 211 300 | 7/1974 |
| FR | 2 566 293 | 12/1985 |

OTHER PUBLICATIONS

Extended European Search Report for EP Application No. 07716504.1, Jan. 30, 2013, European Patent Office, Munich, Germany.

* cited by examiner

*Primary Examiner* — Dana Ross
*Assistant Examiner* — Pradeep C Battula
(74) *Attorney, Agent, or Firm* — Stites & Harbison PLLC; Marvin Petry

(57) ABSTRACT

A formation tool is used for deforming sheet metal on punching machines. The formation tool has an upper or top die tool and a lower or bottom die tool. Toward the top die, there is an upper mold insert movable relative to a holding-down device, and toward the bottom die, a lower mold insert movable relative to a stripper plate. The deformation of the metal sheet is effected upward with respect to a punching stroke plane. The formation tool has a lifting device for aiding in lifting the lower mold insert from an initial position which is at or below the punch stroke plane before a deforming operation, to a level above the punching stroke plane.

3 Claims, 5 Drawing Sheets

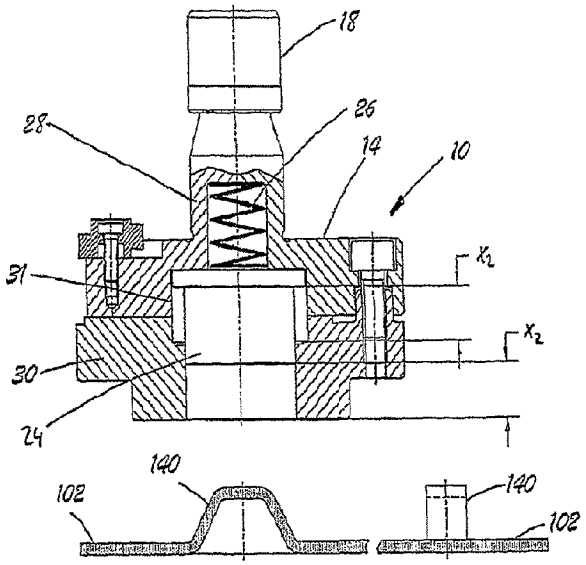
Fig. 2
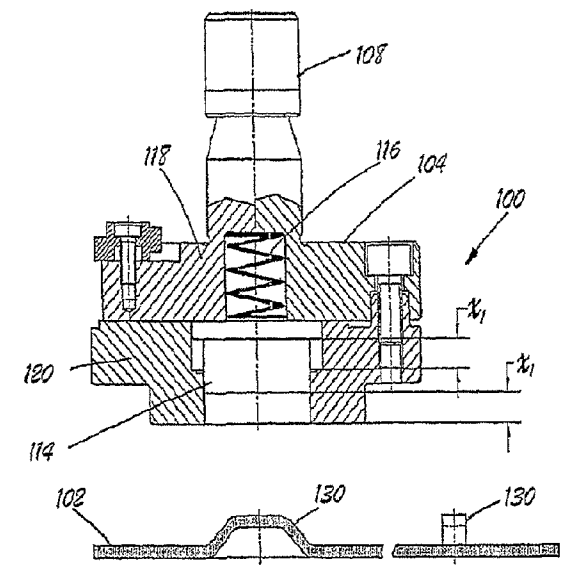
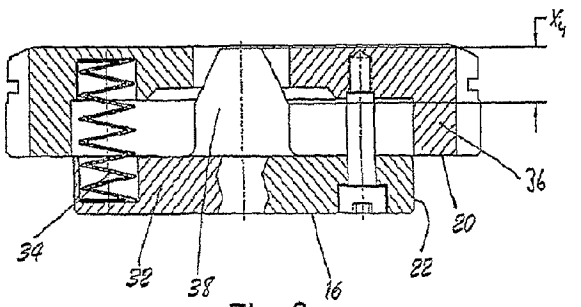
Fig. 1
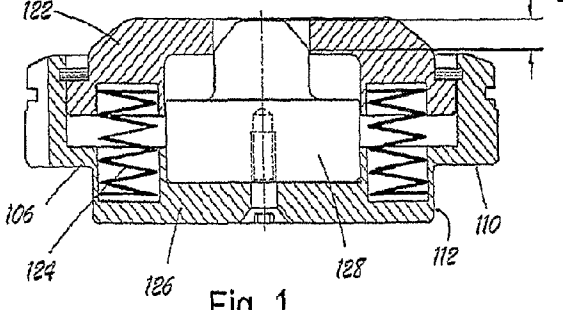

FORMATION TOOL FOR A PUNCHING MACHINE

CROSS REFERENCE TO RELATED APPLICATIONS

This application is a divisional of application Ser. No. 12/160,514, filed Jul. 10, 2008, now abandoned which is the National Stage of International Application No. PCT/US2007/000657, filed Jan. 11, 2007 (which is hereby incorporated by reference).

FIELD OF THE INVENTION

The present invention relates to a formation tool for use in a punching machine for sheet metal deformation and, in particular, to a formation tool which has an upper or top die tool and a lower or bottom die tool for use in a punching machine having a gripper system which transports the two tool parts for a single machining operation.

BACKGROUND OF THE INVENTION

Prior punching machines include revolver punches and TRUMPF® system punches. In revolver punches, the top die tools and bottom die tools are each received in a revolver-like tool holder. Unlike revolver punches, the TRUMPF® system has a gripper system which transports the two tool parts, each for one machining operation, and inserts them into a processing station. The TRUMPF® system can use both punching tools and formation tools. Formation tools can be used to produce reliefs, folds, eyelets, or other shapes in sheet metal workpieces.

The sheet metal workpieces to be processed are moved horizontally on a workbench in what is referred to as a punching stroke plane, so that the workpiece can be positioned properly at the processing station. Deformations are, as a rule, done in an upward direction to prevent the workpiece, upon a motion for subsequent processing operations, from sliding onto what then are downward protrusions instead of sliding onto its flat underside. However, a prerequisite of the upward deformation of the sheet is that in a formation tool, the lower mold insert during a deforming operation remains at a level above the punching stroke plane.

In prior formation tools, a rigid lower mold insert is provided which, in accordance with the deformation to be done, protrudes past the level of the punching stroke plane. In order for the sheet metal workpiece to be transported properly and without damage to the processing station, in conventional formation tools, it is necessary for the stripper plate toward the bottom die, in its initial position, to rest with its top side at the level of the upper edge of the lower mold insert. This means that the sheet metal workpiece, on being transported to the processing position, must be lifted to the level of the lower mold insert via lateral stop chamfers on the stripper plate. In the case of vulnerable surfaces, this can cause processing scratches on the underside of the sheet metal workpiece. In the ensuing deforming operation, the holding-down device of the upper tool insert presses the sheet down laterally of the two aligned mold inserts, so that the desired formation takes place. When the upper or top die tool is lifted again, springs then lift the sheet metal workpiece again and it is moved laterally, whereupon it is again shifted downward onto the punching stroke plane, so that once again there is a risk of damage to the underside of the workpiece.

SUMMARY OF THE INVENTION

An object of the present invention is to create a formation tool which permits deformation processing of sheet metal workpieces on punching machines, such as those of the TRUMPF® system, without requiring that the workpieces be lifted out of the punching stroke plane when being transported to the processing position.

According to the invention, this object is attained by a formation tool in which the formation tool has a lifting device for aiding in lifting the lower mold insert from a level at or below the punching stroke plane before a deforming operation to a level above the punching stroke plane.

The formation tool of the present invention offers the advantage that in an initial position, no part of the lower bottom die tool protrudes past the level of the punching stroke plane so that the sheet metal workpiece can be transported to the processing position without a change in its horizontal position. Next, in the cooperation of the lifting device with a punching stroke of the punching machine, a desired deformation is made in the sheet metal workpiece. It does not matter whether—as is preferred—first the lower mold insert is lifted by actuation of the lifting device and then the punching stroke is performed, or vice versa. The synchronous motion of the lifting device with the punching stroke is also readily available. Because the initial position of the sheet metal workpiece is at the lower level of the punching stroke plane, the formation tool of the present invention now permits a larger variety of possible shapes, which can be nearly twice as high as those that can be made with formation tools of the prior art.

One advantageous embodiment of the invention comprises an upper edge of the stripper plate toward the bottom die disposed at the level of the punching stroke plane. This configuration allows for an especially favorable contact of the sheet metal workpiece with the device during the shifting operation, providing for a maximum capacity for a change in shape.

In a further preferred embodiment of the invention, the lifting device substantially comprises a lifting element, disposed in a workbench, and a final control element disposed on the lower end of the lifting element. The lifting element has a cross section appropriately sized for the opening in the processing station. The disposition of the final control element on the lower end offers the advantage that the final control element itself need not be accommodated in the workbench, but instead can be disposed in the free space existing below the workbench. There is also sufficient space to accommodate the hydraulic, pneumatic, or electric connection lines that are required, depending on the type of final control element.

In an especially preferred embodiment of the invention, the lifting element is in the form of a tubular body. The tubular body first offers the advantage that the lifting device can remain in the processing station even if the top die tool and bottom die tool of the formation tool are not used and a punching tool is, for instance, used instead. In that case, the tubular body offers the opportunity for punched-out sheet metal parts to drop downward through its interior to under the workbench and be transported away from there. Moreover, a tubular body is a relatively lightweight lifting element, which is nevertheless capable of absorbing the forces between the final control element and the workpiece that occur during the forming operation.

In a further preferred embodiment of the invention, it is provided that the tubular body, in its lower region, has at least one lateral opening, preferably two diametrically opposed openings. The openings serve to allow pressed-out sheet metal parts to fall laterally out of the tubular body, which makes it possible in a still further preferred embodiment of the invention to have a piston of the final control element engage the lower end of the tubular body. Such an arrangement is more favorable from the standpoint of stability than to have the final control element engage the tubular body laterally and for the tubular body to be open at the bottom, allowing the punched parts could fall directly downward out of the tubular body. However, in principle, both embodiments are possible.

In the case of a piston engaging the lower end of the tubular body, it is especially preferable to include a cylindrical protrusion whose outer diameter is equivalent to the inside diameter of the tubular body. In this configuration, a secure engagement of the piston inside the tubular body transmits the forces required during a punching operation.

Preferably, the cylindrical protrusion has a gable end, and the sides are located at the level of the lower edges of the two lateral openings, and the apex of the gable forms a protrusion, between the two openings, that divides the tubular body. The gable end of the protrusion of the piston assures that punched-out sheet metal parts can no longer fall out of one of the two openings, which prevents punching waste from accumulating in the tubular body, where after a certain number of punching operations they can plug it up.

BRIEF DESCRIPTION OF THE FIGURES

Below, one exemplary embodiment of the invention is described in conjunction with the accompanying drawings.

FIG. 1 shows a longitudinal section through a formation tool of the prior art;

FIG. 2 shows a longitudinal section through a formation tool of the present invention;

DETAILED DESCRIPTION

Figure 3:
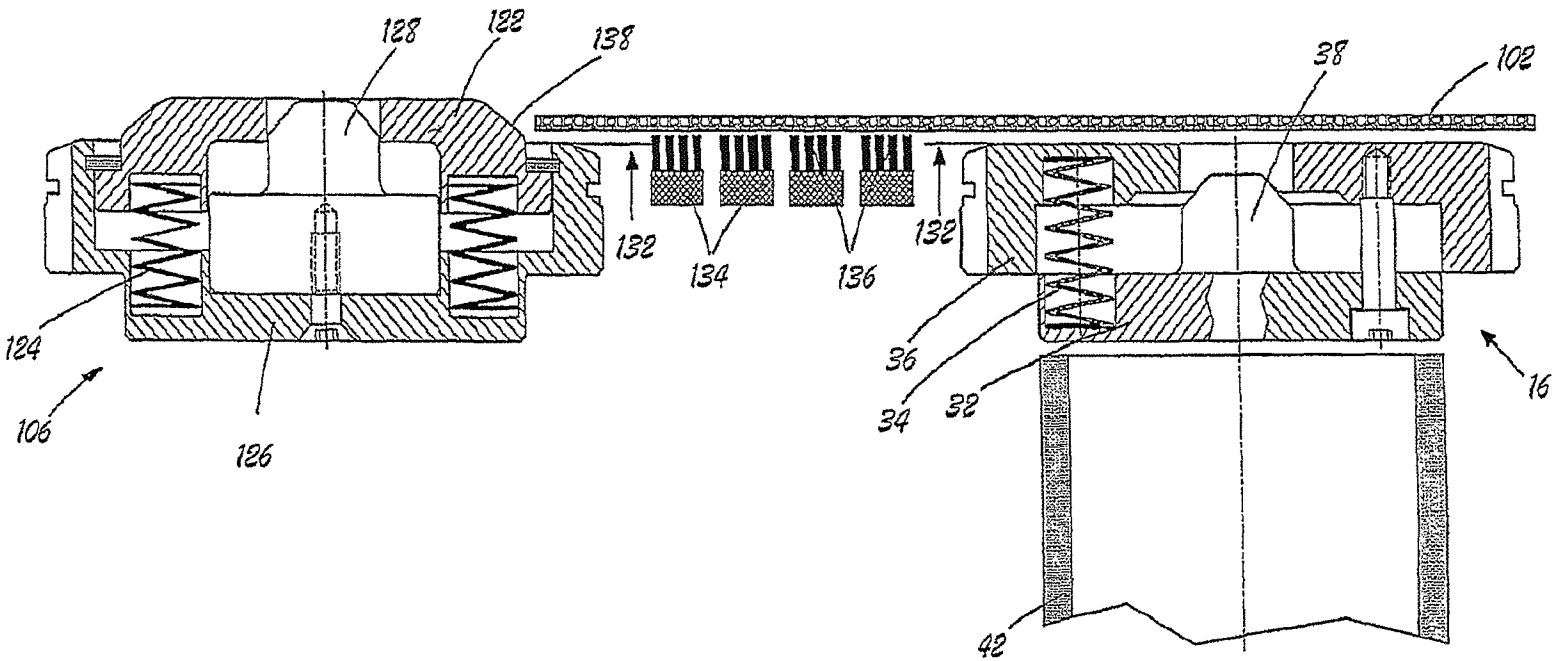
FIG. 3 is a comparative longitudinal section of a bottom die tool of the prior art and a bottom die tool of the present invention with an associated lifting element and a sheet metal workpiece located in the punching plane.

In FIG. 1, a prior art formation tool 100 is used in punching machines of the TRUMPF® system for forming sheet metal workpieces 102. The formation tool comprises an upper or top die tool 104 and a lower or bottom die tool 106, which can each be inserted into respective mounts in a processing station. To that end, the top die tool 104 has a suitably shaped shaft 108, while the bottom die tool 106 has a contact face 110 and, with a cylindrical protrusion 112, engages a corresponding recess in the processing station.

The top die tool 104 has an upper mold insert 114, which is braced via a helical spring 116 on a top die body 118. A holding-down device 120 is also solidly joined to the top die body 118 and presses the sheet during a punching stroke against a stripper plate 122 of the bottom die tool. The stripper plate 122 is braced resiliently on a bottom die body 126 via helical springs 124, with which body a lower mold insert 128 is rigidly connected and cooperates with the upper mold insert 114, in order for a punching stroke to form a relief 130 in the sheet metal workpiece 102. Such deformations are, as a rule, molded upward, so that the workpiece can be moved sliding on its underside, whereas downward formed deformations would interfere.

The location of the bottom die tool 106 in the processing station can be seen on the left-hand side in FIG. 3. A punching stroke plane 132 is defined by the location of the workpiece 102, shown here slightly elevated, on the workbench. The workpiece 102 is braced by holders 134 with brushlike protrusions 136. It can be seen clearly from FIG. 3 that the lower mold insert 128 protrudes markedly past the punching stroke plane 132, and the stripper plate 122, in the initial position shown, is in alignment with the upper edge of the mold insert 128. If the workpiece 102 is to be movable at all into the processing station when the formation tool 100 is located there, the edges of the stripper plate 122 have stop chamfers 138, so that on being transported to the processing station the workpiece 102 is raised above the level of the mold insert 128. If there are vulnerable surfaces on the underside of the workpieces 102, damage that is at least problematic visually can occur, so that this surface can no longer be used as a visible surface if, for instance, only a coating with clear lacquer is to be applied or if no further treatment whatsoever is contemplated.

Figure 5:
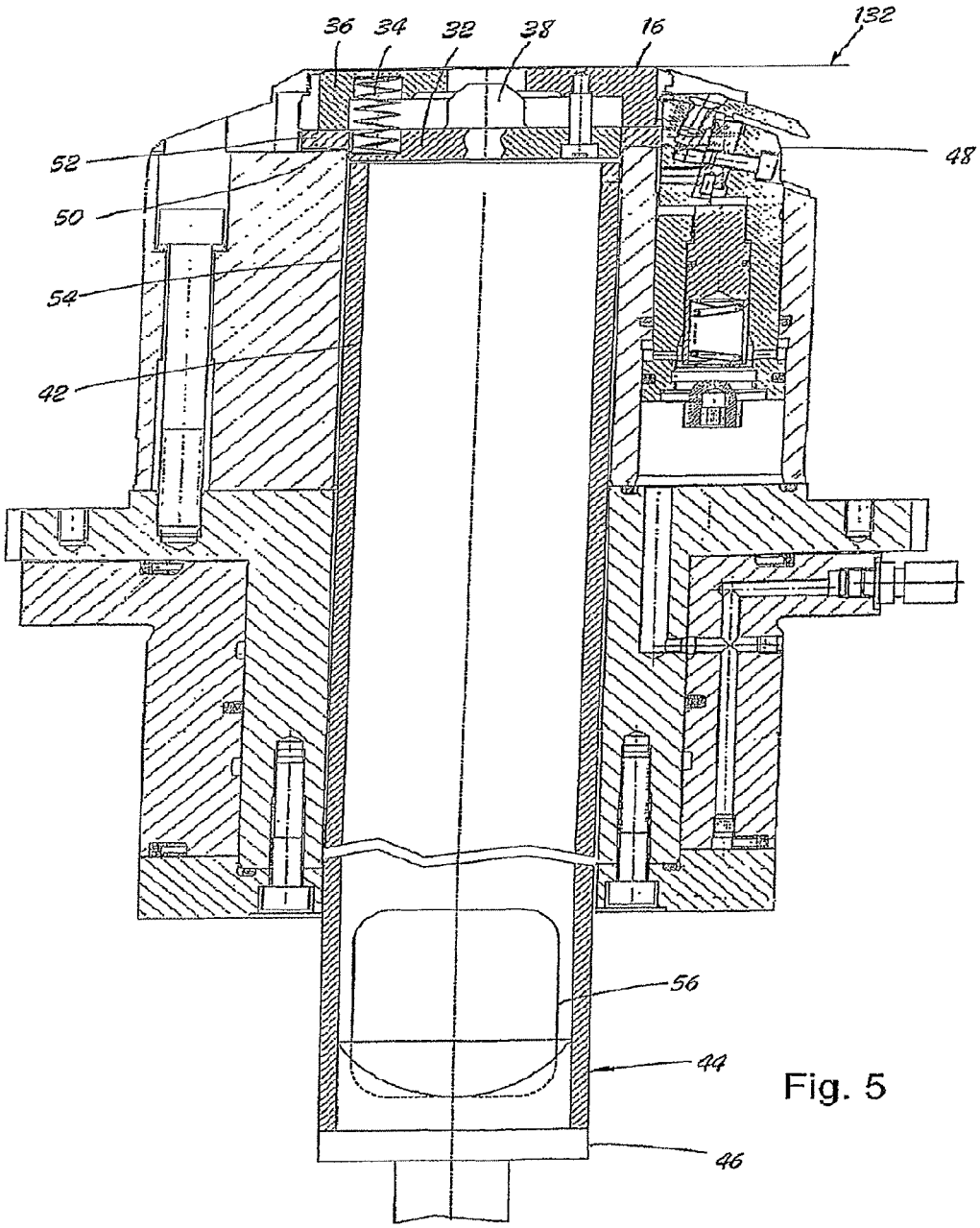
FIG. 5 is a section through a lower machining station of a punching machine of the TRUMPF® system, with the bottom die tool of the invention inserted and with an associated lifting device.

In FIG. 2, a formation tool 10 according to the present invention is shown, which avoids raising the workpiece 102 in the processing station. The formation tool 10 comprises a top die insert 14 and a bottom die insert 16, whose connection dimensions are such that they fit into the corresponding tool holders of a punching machine of the TRUMPF® system. Accordingly, the top die insert 14 has a shaft 18, which corresponds to the shaft 108 of the top die insert 100, shown in FIG. 1. The bottom die insert 16 has a contact face 20, with which it rests in a contact region of the processing station (FIG. 5).

The top die insert 14 also has an upper mold insert 24, also referred to as a recessed mold part, which is braced via a helical spring 26 on a top die body 28. A holding-down device 30 guides the upper mold insert 24, and the most essential difference on the part of the top die insert 14 shown in FIG. 2, compared to the top die insert 114 shown in FIG. 1, is that the possible stroke length of the upper mold insert 114 is increased by the widened recess 31 in the top die body. This is illustrated by the two reference symbols $x_1$ in FIG. 1 and $x_2$ in FIG. 2.

A bottom die body 36 forms the stripper plate, while a lower mold insert 38, also referred to as a male mold part, is braced on the bottom die body 36 via helical springs 34 for bottom die tool 16. The lower mold insert 38 is formed integrally with an insert plate 32, but alternatively can be designed separately from it as a separate or discrete part. The insert plate 32 has a cylindrical outer circumference 22 which fits into a recess of the processing station (FIG. 5).

Figure 4:
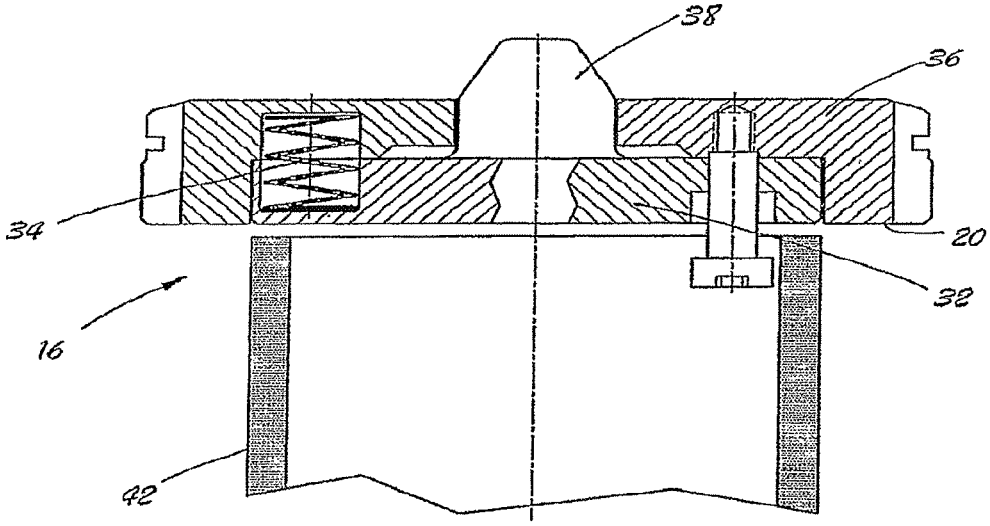
FIG. 4 shows the bottom die tool of FIG. 3 with the lifting element raised.

As can be seen from FIG. 3, in the relaxed or initial position, all parts of the bottom die tool 16 are located below the punching stroke plane 132, so that when there is a formation tool 10 in the processing station, the workpiece 102 can be transported to the processing position without a change in the level or horizontal height of the workpiece. To enable performing a deformation process that is oriented upward, it is then necessary, however, either before or during the performance of the punching stroke, to raise the lower mold insert 38, with the insert plate 32, to the processing position shown in FIG. 4 with the aid of a lifting element 42 formed as a tubular element. With the lower mold insert 38 in its raised position, the punching stroke is then performed, so that the relief 140 can be made in the workpiece 102. Because of the lower level of the stripper plate 36, a greater deformation distance is now possible relative to that of a conventional tool, as indicated by the relief 140 and the reference symbols $x_3$ in FIG. 1 and $x_4$ in FIG. 2. The greater relative stroke necessary for this, between the upper mold insert 24 and the top die body 28, is realized by means of the larger recess 31, previously mentioned, and the longer stroke length of the mold insert 24 that this makes possible.

As noted, in comparison to the prior art formation tools, such as formation tool 100, the present formation tool 10 has a movable lifting element, such as piston 46, which is a component of a lifting device 44 (FIG. 5). The lifting piston 46 is connected to a hydraulic, pneumatic, or electric final control element. In FIG. 5, the lower tool receptacle 48 of a processing station of a punching machine of the TRUMPF® system is shown. This kind of tool receptacle 48 is well known in the art and therefore there is no need to describe it in further detail.

The tool receptacle 48 has a contact face 50 on which a spacer ring 52 is disposed. The inside diameter of the spacer ring 52 essentially corresponds to a recess 54 in the workbench, into which recess the insert plate 32 protrudes, and in which recess the tubular lifting element 42 is disposed. The tubular body 42, in contrast to the top die tool 14 and the bottom die tool 16, is not removed from the processing station when a punching operation, for instance, is to be performed in it with a correspondingly provided punching tool. This kind of removal would not be readily possible because of the great length of the tubular body 42, even if the tubular body 42 were detachably disposed on the piston 46. However, because the lifting element 42 is a tubular body, its removal is not even necessary, since the inside cross section of the tubular body 42 offers enough free space for punched-out sheet metal parts to drop downward. To keep the punching waste from accumulating in the tubular body 42, two diametrically opposed openings 56 are provided in its lower region, through which the punching waste can fall laterally out of the tubular body 42.

Figure 6:
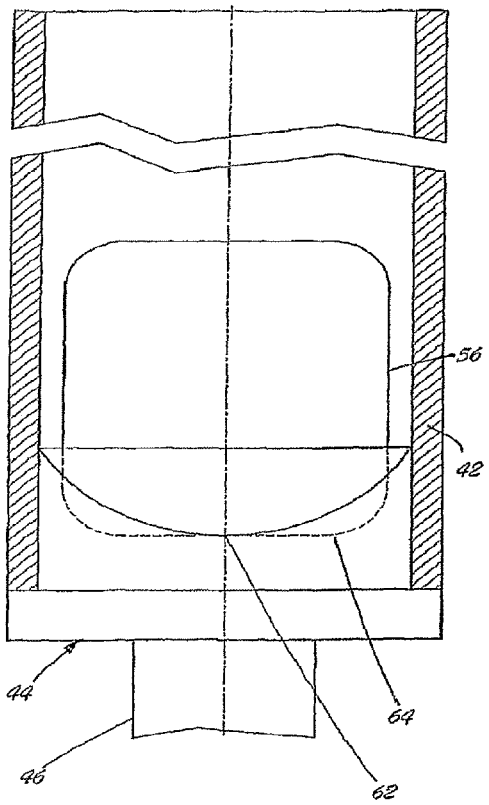
FIG. 6 is a fragmentary sectional view of the lifting device of FIG. 5.
Figure 7:
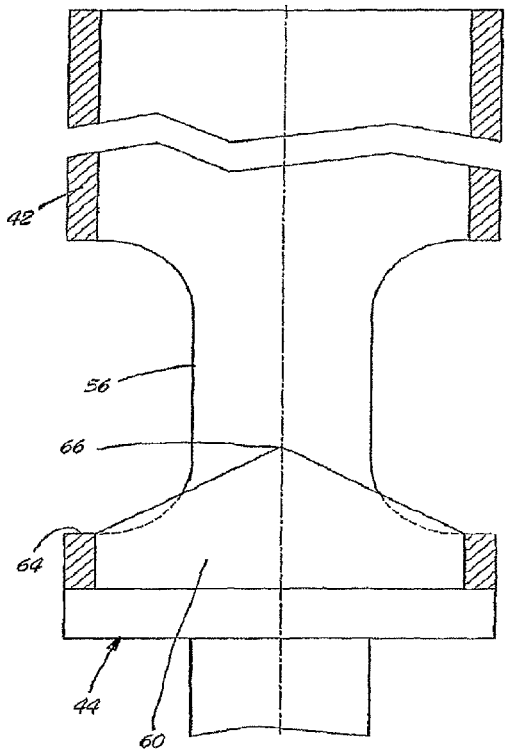
FIG. 7 is a fragmentary sectional view, rotated 90°, of the lifting device of FIG. 6.

Openings 56 and piston 46 can be seen in greater detail in FIGS. 6 and 7. The two openings 56 are shaped in such a way that between them, relatively wide wall portions 58 remain, which can absorb the forces that occur in operation. The central engagement of the piston 46 with the lower end of the tube has proved advantageous because the forces can be transmitted especially well, and without further securing flanges, between the final control element and the tubular body 42. To enable the punching waste to fall securely out of the lateral openings 56, the piston 46 has a cylindrical protrusion 60 at its top, and the top of the protrusion has a gabled end. The lower edges 62 of the gabled end are approximately flush, in the middle region, with lower edges 64 of the openings 56, while the apex 66 of the gable forms a protrusion between the two openings 56 that divide the hollow body. In conjunction with the slopes of the gable, this protrusion 66 assures that the punching waste will be securely carried to the outside through the lateral openings.

As a rule, the course of the deforming operation will be such that before the punching stroke of the punching machine is performed, the piston 46, with the aid of the final control element, will first lift the tubular body 42 and, thus, also the insert plate 32 and the lower mold insert 38. In this way, work can be done with very slight adjusting forces. A self-locking drive, for instance, can then absorb the much stronger forces that occur during the deforming operation. In principle, however, it is also possible to perform the punching stroke and the lifting motion of the lifting device synchronously, or even, given a suitable embodiment of the final control element, to provide a course in which first the top die tool is lowered onto the surface of the workpiece, and then the shaping operation is performed with the aid of the lifting device 44.

Depending on the form of the formation tools, reliefs, louvers, beads, reliefs, folds, and other shaping machining operations can be performed.

It will now be clear to one of ordinary skill in the art that formation tool 10 provides advantages over prior devices, especially wherever workpieces have a surface that is especially vulnerable to scratching, or where major changes in shape are important, which are made possible by the relatively lower disposed stripper plate 36.

Although the invention has been described in considerable detail with respect to preferred embodiments, it will be apparent that the invention is capable of numerous modifications and variations, apparent to those skilled in the art, without departing from the spirit and scope of the claims.

The invention claimed is:

1. A punching machine comprising a formation tool having an upper die tool and a lower die tool and including structure which supports a sheet metal workpiece for movement between the upper die tool and the lower die tool in a punching stroke plane, a cylindrical recess, the lower die tool being positioned at the top of the cylindrical recess and a hollow tubular body which fits into the cylindrical recess, the upper die tool having a recessed mold part, the lower die tool having a stripper plate with an upper stripper surface located at or below the punching stroke plane, the lower die tool having a male mold part which is initially located below the upper stripper surface, the hollow tubular body engaging the bottom of the male mold part, wherein when the male mold part is raised, it mates with the recessed mold part of the upper die tool to deform the sheet metal located between the upper die tool and the lower die tool, the male mold part being movable upwardly across the punching stroke plane to deform the sheet metal above the punching stroke plane and against the interior of the recessed mold part of the upper die tool, the top of the hollow tubular body operatively engaging the male mold part and a powered lifting device engaging the bottom of the hollow tubular body to move the hollow tubular body upwardly to in turn raise the male mold part to mate with the upper die tool.

2. A punching machine according to claim 1, wherein the hollow tubular body has at least one opening in the lower portion thereof.

3. A punching machine according to claim 1, wherein a piston mounted on the punching machine engages the lifting device to move it upwardly.

* * * * *